US011517924B2

(12) United States Patent
Seeberger

(10) Patent No.: US 11,517,924 B2
(45) Date of Patent: Dec. 6, 2022

(54) DISPENSING DEVICE FOR SPRAYING A SPRAYABLE FLUID

(71) Applicant: Gelupas GMBH, Schönaich (DE)

(72) Inventor: Gerhard Seeberger, Schönaich (DE)

(73) Assignee: Gelupas GmbH, Schönaich (DE)

( * ) Notice: Subject to any disclaimer, the term of this patent is extended or adjusted under 35 U.S.C. 154(b) by 143 days.

(21) Appl. No.: 16/072,616

(22) PCT Filed: Jan. 27, 2017

(86) PCT No.: PCT/EP2017/051779

§ 371 (c)(1),
(2) Date: Jul. 25, 2018

(87) PCT Pub. No.: WO2017/129750

PCT Pub. Date: Aug. 3, 2017

(65) Prior Publication Data

US 2019/0076860 A1 Mar. 14, 2019

(30) Foreign Application Priority Data

Jan. 28, 2016 (DE) ..... 202016100418.7

(51) Int. Cl.
*B05B 7/24* (2006.01)
*B05B 7/12* (2006.01)

(52) U.S. Cl.
CPC ..... *B05B 7/2432* (2013.01); *B05B 7/241* (2013.01); *B05B 7/2418* (2013.01);
(Continued)

(58) Field of Classification Search
CPC ..... B05B 7/2432; B05B 7/241; B05B 7/2418; B05B 7/2481; B05B 11/061;
(Continued)

(56) References Cited

U.S. PATENT DOCUMENTS 5,046,667 A 9/1991 Fuhrig
5,192,009 A 3/1993 Hildebrandt et al.
(Continued)

FOREIGN PATENT DOCUMENTS

JP 10305243 A 11/1998
JP WO2015034002 A1 * 12/2015 ..... B05B 7/30
WO WO-2005/070556 A1 8/2005

OTHER PUBLICATIONS

International Search Report for PCT/EP2017/051779, ISA/EP, Rijswijk, NL, dated May 4, 2017, with English translation.
(Continued)

*Primary Examiner* — Tuongminh N Pham
*Assistant Examiner* — Juan C Barrera
(74) *Attorney, Agent, or Firm* — Renner, Otto, Boisselle & Sklar, LLP

(57) ABSTRACT

The invention relates to a dispensing device which is intended for spraying a sprayable fluid and is designed in the form of a hand-held unit, having a housing (12), in which are provided an air pump (22) and an electric drive motor (18), which drives the air pump (22), having a spray head (14), which is connected to the housing (12) and is intended for dispensing the fluid, having an accommodating chamber (29), which is arranged in the housing (12) and is intended for a storage container (41), in which the fluid which is to be dispensed is stored, having a fluid line (44), which leads from the storage container (41) to the spray head (14), and having a hose line (36), which leads from the air pump (22) to the spray head (14), wherein the spray head (14) has a first nozzle (46), which is connected to the fluid line (44), and, separately from said first nozzle, a second nozzle (38), which is supplied with the air flow from the hose line (36), and an atomizing zone (49) is formed outside the spray head (14).

20 Claims, 6 Drawing Sheets

Figure 1:
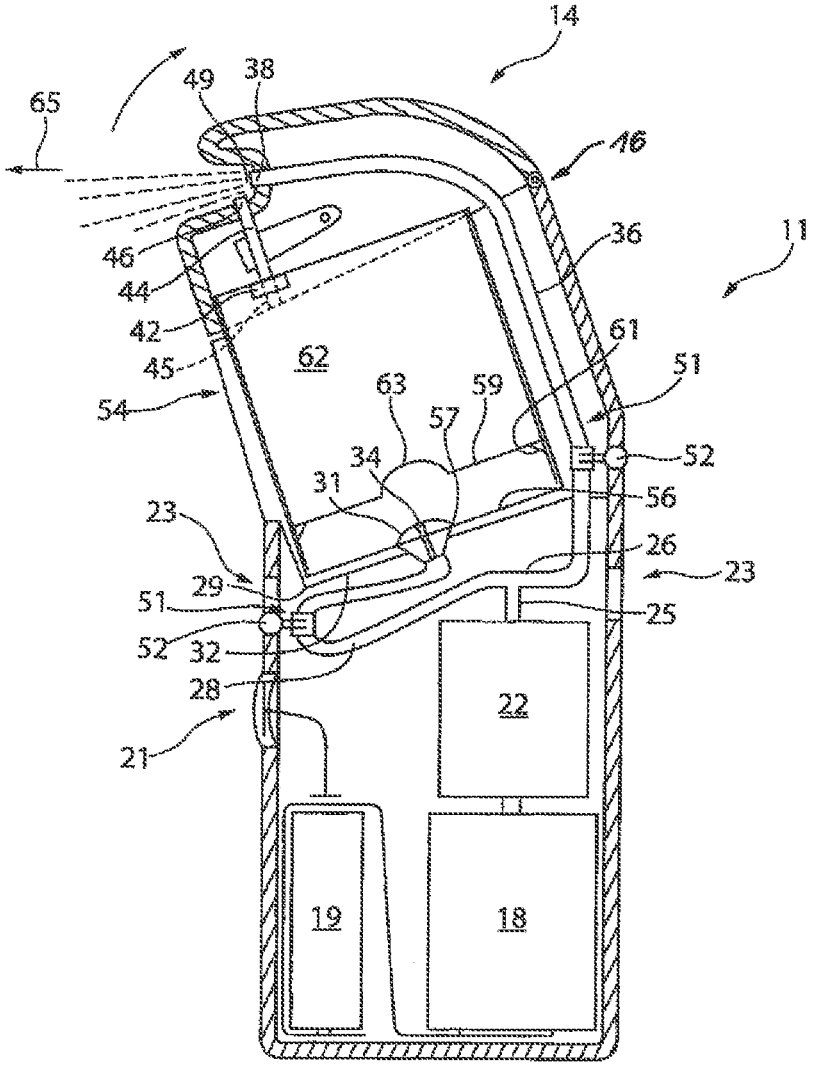

(52) U.S. Cl.
CPC ..... *B05B 7/2481* (2013.01); *A45D 2200/057* (2013.01); *B05B 7/12* (2013.01)

(58) Field of Classification Search
CPC ... B05B 9/0413; B05B 9/0861; B05B 11/048; B05B 7/12; B05B 7/2429; B05B 7/1413; A61M 2205/3331; A61M 2205/8206; A61M 5/142; A61M 1/16; A61M 5/1452; A61M 1/0066; A61M 1/1631; A61M 2205/123; A61M 5/14212; A61M 5/14224; A61M 5/14586; A61M 16/0057; A61M 16/202; A61M 1/1037; A61M 1/1668; A61M 1/3652; A61M 2016/0033; A61M 2205/07; A61M 2205/3396; A45D 34/04; A45D 19/02; A45D 2200/057; A61L 2202/122; A61L 2/0094; A61L 2/24; A61L 2/20; A61H 2201/1238; A61H 2201/0157; A61H 2201/105; A61H 2201/1409; A61H 2201/50; A61H 2201/5025; A61H 2201/5056; A61J 1/20; A61J 1/1406; B65D 88/548; B65D 17/44; B65D 17/42; B05C 17/00586
USPC ..... 239/314, 337–344, 346, 351, 355, 360, 239/361, 364, 373; 222/326, 327, 386, 222/386.5, 387, 388, 389
See application file for complete search history.

(56) References Cited

U.S. PATENT DOCUMENTS 5,452,711 A * 9/1995 Gault ..... B05B 17/0607 128/200.14
5,492,249 A * 2/1996 Beach ..... A23G 9/28 222/105
5,893,515 A * 4/1999 Hahn ..... B05B 11/3028 239/7
6,364,163 B1 * 4/2002 Mueller ..... B05B 11/048 222/105
7,677,467 B2 * 3/2010 Fink ..... A61M 15/0068 239/8
7,779,830 B2 * 8/2010 Koerner ..... A61M 15/0065 128/200.16
2005/0045745 A1 * 3/2005 Kutay ..... B05B 7/2416 239/419
2005/0072860 A1 4/2005 Fedorov
2005/0284963 A1 * 12/2005 Reedy ..... B05B 7/2437 239/526
2008/0265060 A1 10/2008 Canfield et al.
2011/0202019 A1 * 8/2011 Cooper ..... B05B 7/1626 604/291
2012/0067977 A1 3/2012 Spiegel et al.
2013/0017467 A1 * 1/2013 Markoski ..... H01M 8/04201 429/447
2013/0056547 A1 * 3/2013 Wilson ..... B05B 7/2418 239/8
2016/0192760 A1 * 7/2016 Nishiura ..... A45D 34/04 239/337

OTHER PUBLICATIONS

International Preliminary Report on Patentability (Ch. I), IB/Geneva, dated Jul. 31, 2018, incorporating the English translation of the Written Opinion of the ISA/EP, Rijswijk, NL, dated May 4, 2017.

* cited by examiner

DISPENSING DEVICE FOR SPRAYING A SPRAYABLE FLUID

CROSS-REFERENCE TO RELATED APPLICATIONS

This application is a 371 U.S. National Stage of International Application No. PCT/EP2017/051779, filed Jan. 27, 2017. This application claims priority to German Patent Application No. 202016100418.7, filed Jan. 28, 2016. The disclosures of the above applications are incorporated herein by reference.

The invention relates to a dispensing device for spraying a sprayable fluid, which is formed as a hand-held appliance.

A so-called Airbrush System for applying make-up is known. Such appliances are used by professional make-up artists. These have a compressor as well as several hose lines, which extract the respective make-up from individual reservoirs of different make-ups and discharge them via a common spray nozzle. They are cleaned after the respective use, such that these are provided again for subsequent usage. Such Airbrush Systems are, however, not suitable to be taken in a handbag, such that, for example, a fast application or refreshing of the make-up is enabled.

A dispensing device as a hand-held appliance is known from U.S. Pat. No. 5,046,667 A and U.S. Pat. No. 5,192,009 A, which comprises a motor and an air pump in a housing, said pump being driven by the motor. Furthermore, a storage container for the fluid to be applied is arranged in the hand-held appliance. The air and the fluid to be dispensed are mixed in a mixing chamber of the spray head and dispensed via a nozzle. In such hand-held appliances, however, the problem still exists that these very quickly become unable to function, because the fluid to be dispensed dries out. In addition, an application of the medium to be dispensed, in particular make-up, is often uneven, whereby the handling is impeded.

The object of the invention is to create a dispensing device for spraying a sprayable fluid which is formed as a hand-held appliance and has an improved functionality.

This object is solved by a dispensing device in which the spray head has a first nozzle which is in communication with a fluid line and, separately, a second nozzle in the spray head, and the first nozzle is supplied with the air flow from a hose line which is in communication with the first nozzle, and an atomisation zone is formed outside the spray head. This formation of the atomisation zone outside the spray head enables drying-out of the nozzle in the spray head to be prevented. The hand-held appliance is thus usable over an extended period of time. Additionally, a very fine atomisation can be achieved, whereby an even application of the fluid to the skin of the user is possible. Only a selective, targeted fluid application can also thus be enabled, even at a shorter distance of the hand-held appliance from the application site.

A preferred embodiment of the dispensing device provides that the discharge direction of the first nozzle for discharging the air flow and the discharge direction of the second nozzle, via which the fluid is discharged, are orientated relative to each another at an angle of 90° or are orientated relative to each another at an angle of less than 90°. By such an orientation of the two nozzles relative to each other, or the two nozzle channels, a particularly preferred atomisation can take place. It can simultaneously also be achieved that the fluid is conveyed out of the second nozzle according to the Venturi Principle.

A preferred embodiment of the dispensing device provides that the spray head can be arranged on a releasable closure of the storage container. The spray head is thus attachable in a flanged, screwed, clipped or clamped manner. It can alternatively be provided that the spray head is integrated in one piece on the closure of the storage container. It can furthermore be provided that the spray head, the closure and the storage container are formed in one piece, or the spray head is formed in one piece on the storage container and forms the closure simultaneously. These variants enable the spray head and the storage container, which form a unit, to be simultaneously changed during a colour change of the substance to be applied. A mixing of substances can thus be prevented when a fluid remains in the fluid line on the spray head or the nozzle. In the event of a possible impairment of the fluid head, with a storage container which has not yet been used, the fluid can be fully used by means of the possible exchangeability of the spray head It is preferably provided, for simple exchangeability of the spray head, that a connection is provided on the spray head in the opposite direction to the dispensing direction of the first nozzle, said connection being connectable to the hose line in a media-tight manner. A simple plug connection is preferably provided, such that a simple pushing or plugging of the media-tight connection is created after the insertion of the storage container into the housing, with a spray head which has been attached in this manner. Alternatively, such a plug interface can enable a simple binding in the event of an exclusive change of the spray head.

A further advantageous embodiment of the dispensing device provides that the spray head, the closure and/or the storage container are exchangeable with respect to the housing and are preferably releasable with respect to one another by means of a latching, plugging, clamping, clipping, or screwing connection and/or attachable to the housing. This enables a simple exchangeability of the individual components or of a unit which preferably consists of a storage container and a spray head arranged thereon.

A further advantageous embodiment of the dispensing device provides that, for discharging the fluid via the nozzle which is in communication with the storage container, an air flow exits the further nozzle in the spray head with a flow volume of 1 to 10 litres/minute (Um), in particular 1 to 5 litres/minute. A sufficient atomisation, firstly, and a sufficiently large spraying surface having an even concentration of the fluid can thus be achieved.

Fluids are advantageously provided in the storage container which consist of natural, in particular plant substances on a water basis. These are especially suitable for the dispensing of such a dispensing device.

An alternative embodiment of the dispensing device provides that the air flow which is generated by an air pump supplies a hose line, which leads to the spray head, after leaving the air pump and supplies a pressure line which leads into a receiving space in which a storage container having the fluid to be dispensed is arranged. This arrangement has the advantage that discharging of the sprayable fluid from the receiving space is controlled by means of the air flow delivered to the receiving space, while, separately, an air flow is led to the spray head in order to then subsequently atomise and spray the sprayable fluid which has been supplied to the spray head from the storage container. Thus, drying out of a fluid line leading to the spray head can be prevented, whereby this hand-held appliance remains usable over a longer period of time. Additionally, it can be achieved by this separation that, with respect to the pressurisation of the storage container and the delivery of the spraying air via the hose line, the storage container—also when the fluid is not fully used up—can be exchanged and replaced by another, also in particular when another colour selection is desired.

Advantageously, the spray head has a first nozzle which is in communication with the fluid line, and, separately, a second nozzle which is supplied with the air flow from the hose line, wherein the second nozzle is orientated in the discharge direction and the first nozzle is substantially perpendicular thereto. This enables a separate delivery of the sprayable fluid and the spraying air via the hose line to be provided, such that an atomisation and spraying of the fluid takes place after dispensing of the two media from the nozzles. Both adhering and drying out of the nozzles are thus prevented.

According to a first embodiment, the hose line opens into a closed pressure space in the spray head, and the air accumulated in the pressure space exits via the second nozzle. This has the advantage that pressure peaks in the air flow, which can arise during generation of an air flow by the air pump, can be reduced. Alternatively, the second nozzle can be directly in communication with the hose line.

Furthermore, an air pressure regulator, which is preferably to be actuated by a control member arranged on the housing, is provided in the hose line or the pressure line or in both. A simple adjusting of the order quantity of fluid or the degree of atomisation of the fluid by the amount of spray force is thus enabled.

The pressure line leading to the receiving space is preferably attached to a connecting piece on the receiving space, preferably at the base of the receiving space. An inlet opening provided in the connecting piece preferably points into the receiving space. Thus, the air flow generated by the air pump is introduced into the receiving space in a defined position. Additionally, a connecting point for a storage container can thus be created, in order that this storage container is directly or also indirectly pressurised by the air flow introduced into the receiving space.

According to a first embodiment of the storage container, it is formed as a cartridge having a displaceable base which can be inserted into the receiving space. Advantageously, the cartridge surrounds the inlet opening of the connecting piece or the connecting piece in an air-tight manner. A simple structure is thus enabled.

An alternative embodiment of the receiving space as a cartridge provides that it has a cartridge base that comprises a connection opening or outlet opening which surrounds an inlet opening of the connecting piece in an airtight manner. There can thus be a direct coupling of the cartridge with the connecting piece. Such a cartridge can also have a displaceable base, whereby this base is displaced in the direction of the dispensing opening by means of the pressurisation. The design of such storage containers enables the receiving space not to have to be sealed in an air-tight manner. Additionally, there can be a check for the user for proper connection and insertion of the storage container into the receiving space by means of clipping in or snapping in or similar.

In the embodiment of the storage container as a cartridge having a displaceable base, it preferably has a sealing lip engaging an inner casing surface of the cartridge on the outer periphery. The base is thus, firstly, sealed sufficiently with respect to the casing surface, and, secondly, it can be achieved by the sealing lip that the base is displaceable in only one direction in order to discharge the fluid, and in the opposite direction a movement direction is blocked by the sealing lip.

A further preferred embodiment of a displaceable base in a cartridge formed as a storage container comprises the formation of a bulge which is provided centrally in the base surface of the base, wherein this bulge is orientated with respect to the inner space of the cartridge. During the pressurisation of the base, this base bulges. After the drive motor is switched off and the air pump for dispensing fluid is shut down, the pressure space located between the base of the cartridge and the connecting piece is relieved. The base which is bulged due to the pressure applied for dispensing the fluid can be led back into an initial position again after the drop in pressure in the adjacent pressure space, whereby a suction effect is generated in the fluid line leading to the nozzle of the spray head, such that this fluid line can be drained independently. Additional drying out of the fluid in the fluid line is thus prevented.

The storage container can alternatively also be formed as a tubular bag which can be inserted into the receiving space, wherein the receiving space is preferably closed in an air-tight manner after the insertion of the tubular bag. Thus, by the pressure build up in the receiving space due to the air flow passing into the receiving space through the inlet opening, a dispensing of the fluid from the tubular bag can in turn be controlled.

For exchanging the storage container, the spray head is advantageously arranged pivotably relative to the housing, such that this spray head can be elevated from the housing or pivoted into an open position. Subsequently, a simple removal and a reinsertion of a storage container can be enabled. This advantageously hinged arrangement of the spray head on the housing has the advantage that the spray head cannot be detached from the housing. Thus, an unintended withdrawal of the hose line to the further nozzle of the spray head is also prevented.

An alternative embodiment of the dispensing device provides that the spray head is received on the housing by a guide in a longitudinally displaceable manner and can be transferred from a closed position into an elevated position for exchanging the storage container. In this embodiment, the spray head can be elevated from the housing by being pulled upwards or a displacement movement, such that the receiving space in which the storage container is positioned becomes freely accessible from outside. A simple removal and a fitting of the storage container in the receiving space can thus be enabled. Preferably, the displacement movement is designed such that the fluid line, which has a needle on one end, is elevated to the point where a safe removal of the storage container is enabled. Preferably, the spray head can be latched both in the closed position and in the elevated position or can occupy a self-latching position. Likewise, a locking element for releasing and securing the closed position or the two positions can be provided.

The fluid line arranged in the spray head has a needle opposite the spray head, said needle being immersed in an opening in the storage container when closing the spray head relative to the housing. This enables a simple and secure changing of the storage container.

Preferably, this storage container has a self-healing closure for insertion and withdrawal of the needle of the fluid line. The storage container is thus directly usable and ensures that, during replacement of a not fully emptied storage container, an unintended exit of the fluid is prevented. Additionally, a portion of the fluid still remaining in the storage container is prevented from drying out.

Preferably, a protective device for the needle is provided in the spray head on the fluid line. This protective device transitions into a protective position relative to the housing during opening of the spray head. Advantageously, this takes place by means of gravity or an energy storage element. As soon as the spray head is transferred into a closed position relative to the housing again, the protective device returns independently to an initial position, such that the needle can be immersed in the self-healing closure of the storage container.

An accumulator for power supply to the drive motor is preferably provided in the housing. Advantageously, a charging connection can additionally be provided.

Figure 2:
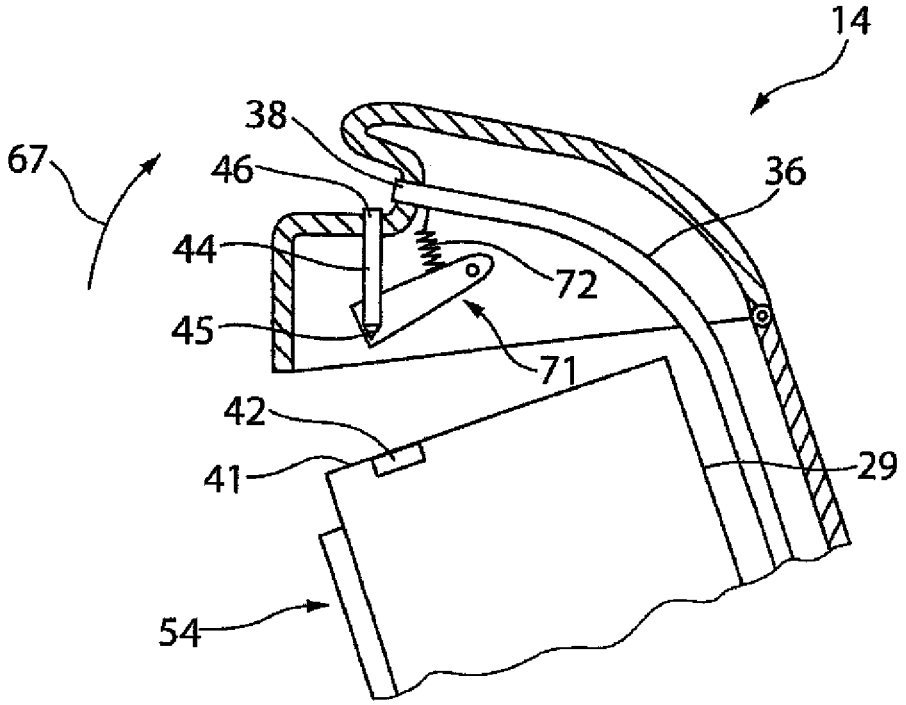
Figure 3:
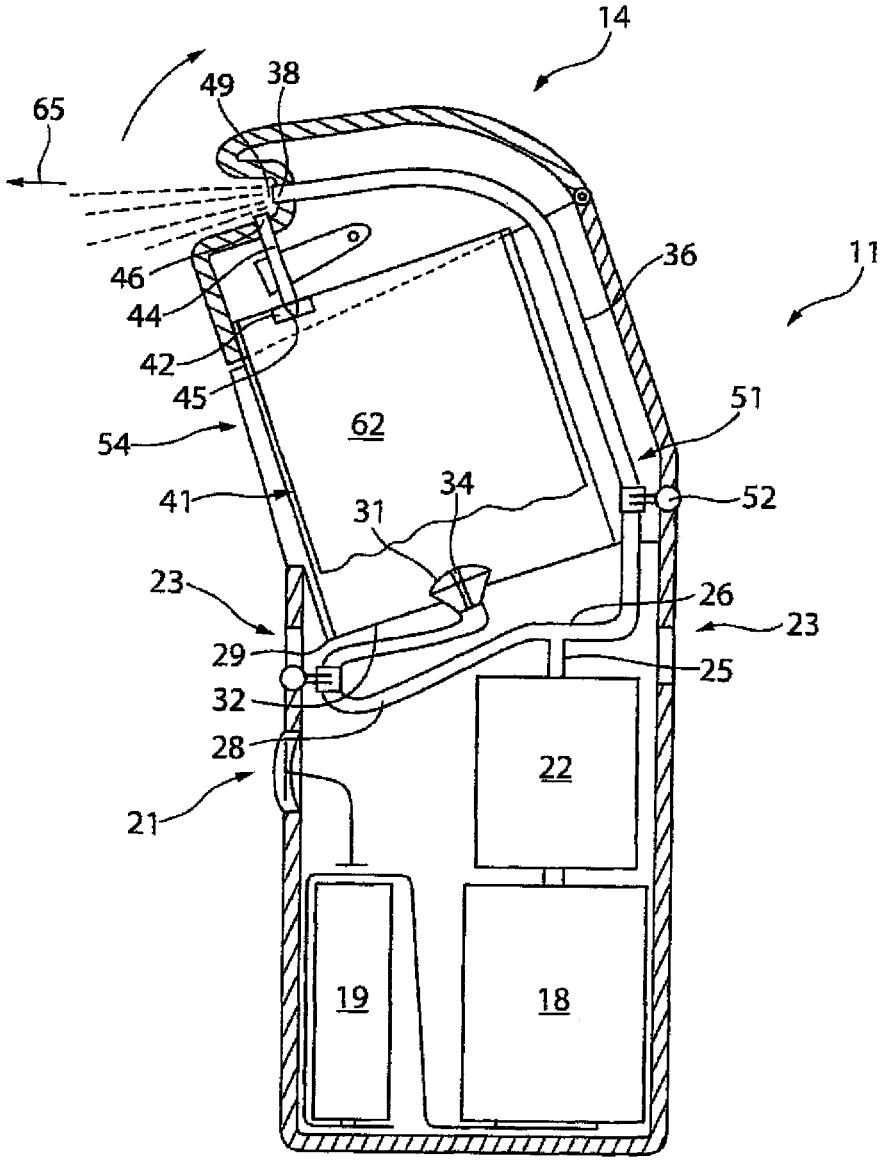
Figure 4:
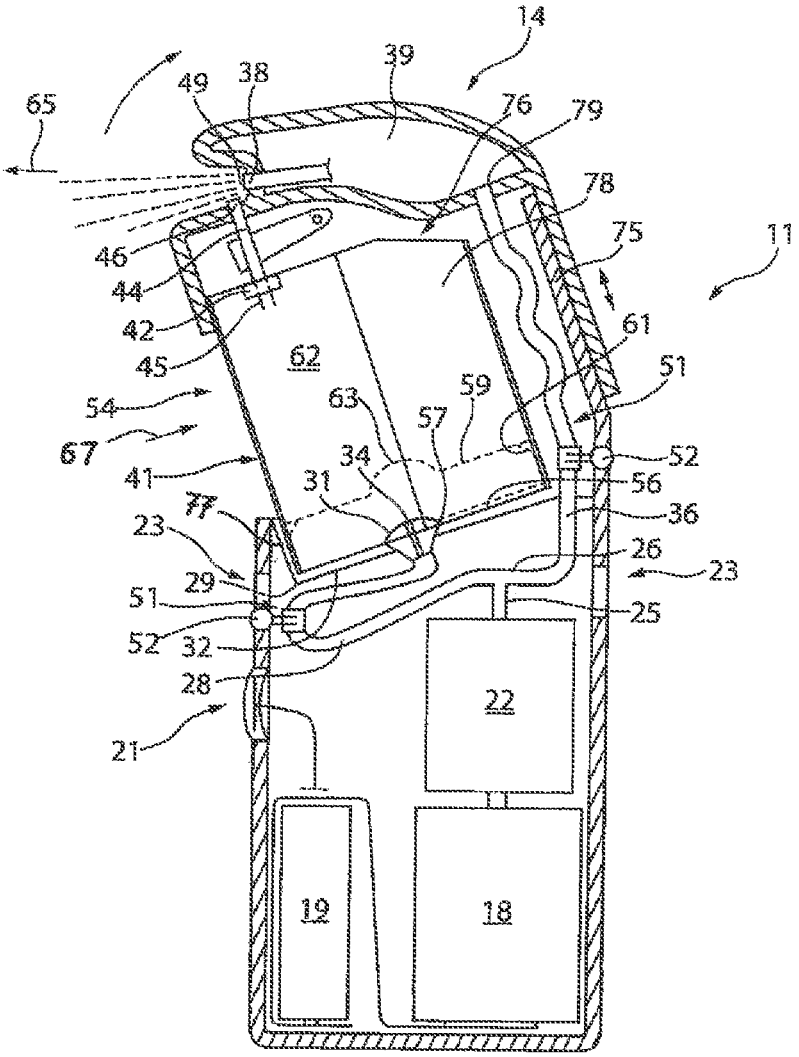
Figure 5:
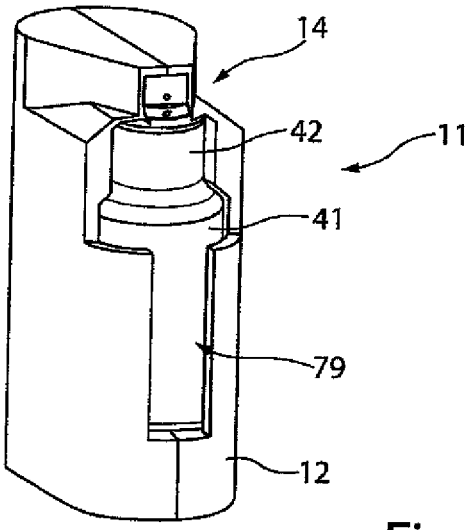
Figure 6:
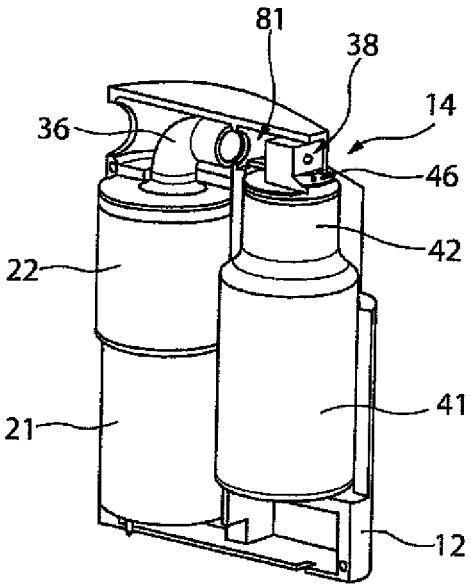
Figure 7:
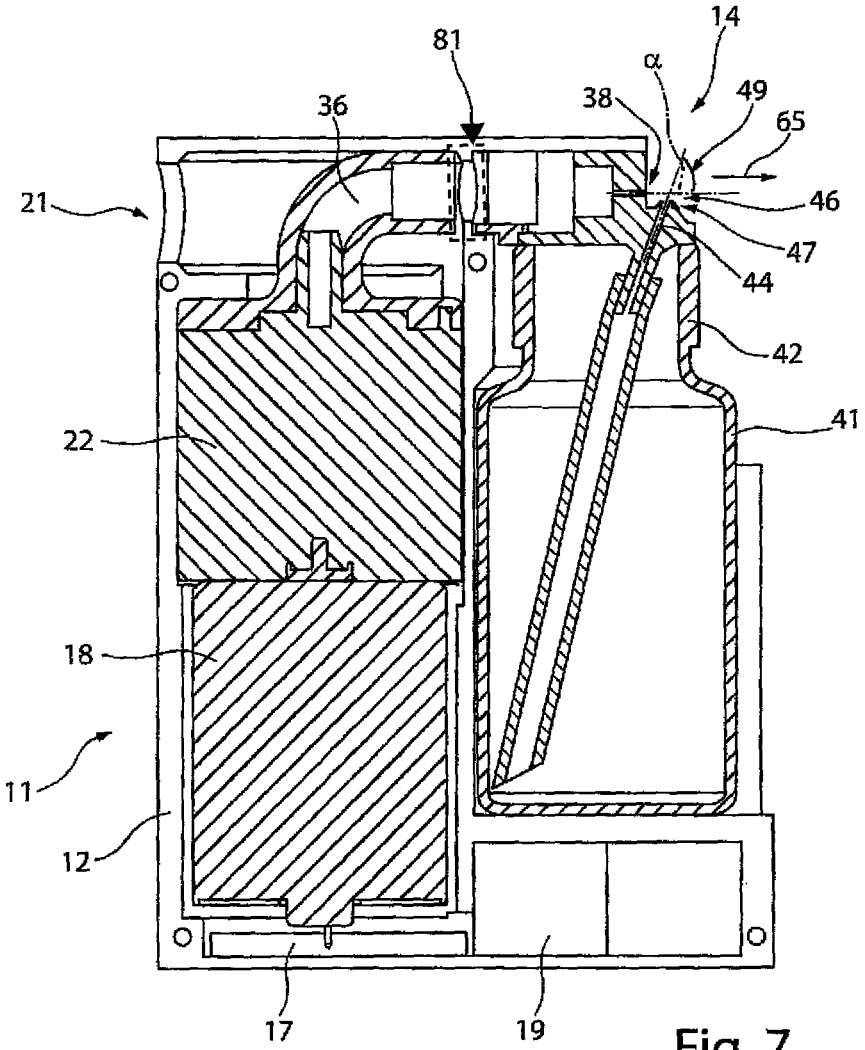
Figure 8:
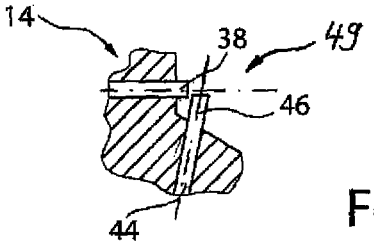

The invention as well as further advantageous embodiments and developments of the same are described in further detail and explained in the following using the examples depicted in the drawings. The features to be taken from the description and the drawings can be applied individually or in any combination. Here are shown:

FIG. 1 a schematic sectional view of a first embodiment of the dispensing device as a hand-held appliance, FIG. 2 a schematic sectional view of a spray head of the dispensing device, said spray head being open to the housing, FIG. 3 a dispensing device according to FIG. 1 having an alternatively formed storage container, FIG. 4 a schematic sectional view of an alternative embodiment to FIG. 1, FIG. 5 a perspective view of an alternative embodiment of the dispensing device to FIG. 1, FIG. 6 a schematic detail view of the embodiment of the dispensing device according to FIG. 5, FIG. 7 a schematic sectional view of the alternative embodiment according to FIG. 5 and FIG. 8 a schematic detail view of a spray head.

In FIG. 1, a schematic sectional view of a dispensing device 11 for a spray-like fluid is depicted. In particular, this dispensing device 11 is provided as a hand-held appliance for dispensing make-up. The dispensing device 11 comprises a housing 12 as well as a spray head 14 arranged on the housing 12. The spray head 14 is preferably provided to be releasable relative to the housing 12. For example, this spray head 14 can be provided to be pivotable relative to the housing 12 by means of a hinge 16, such that it is transferred from a closed position, as is depicted in FIG. 1, into a partially open position, as is depicted in FIG. 2, or into a fully open position. In the fully open position, the spray head 14 is pivoted relative to the housing 12, for example by more than 70 degrees.

An electric drive motor 18 is provided in the housing 12. This motor 18 is supplied, for example, by means of an accumulator 19. This motor can be provided to be exchangeable in the housing 12. Alternatively, both a wireless and a wired charging of the accumulator 19 can be provided. The dispensing device 11 is switched on and off by means of an operating button 21. The drive motor 18 drives an air pump 22. This air pump 22 is supplied with air by inlet openings 23 in the housing wall of the housing 12. One or more air inlet openings 23 can thus be provided in the housing wall. The air pump 22 comprises an outlet connector 25, through which an air flow generated by the air pump 22 is dispensed. A branch 26, for example, can be connected to these outlet connectors 25, the air flow generated being distributed by said branch 26. This air flow can be transferred into a pressure line 28 which leads into a receiving space 29 in the housing 12. Preferably, the pressure line 28 is attached to the base 32 of the receiving space 29 by means of a connecting piece 31 and has an inlet opening 34, which opens into the receiving space 29.

The air flow generated by the air pump 22 can furthermore be transferred by means of the branch 26 into a hose line 36. This hose line 36 leads into the spray head 14 and ends in a nozzle 38 for dispensing the air flow.

A storage container 41 can be inserted into the receiving space 29 of the housing 12. This storage container 41 receives the sprayable fluid, in particular make-up. The storage container 41 has a closure 42 on the dispensing side which is preferably formed as a self-healing closure. A fluid line 44 can be connected to this closure 42. Preferably, the fluid line 44 comprises a needle 45 pointing towards the closure 42, such that after the insertion of the storage container 41 into the receiving space 29 and a subsequent closing movement of the spray head 14 relative to the housing 12, the needle 45 of the fluid line 44 engages in the closure 42 and enables dispensing of the sprayable fluid.

The fluid line 44 has a nozzle 46 opposite the needle 45. This nozzle 46 for dispensing the fluid is provided separately from the nozzle 38 for dispensing the air flow to the spray head 14. For example, the nozzles 38, 46 are formed as small tubes. The atomisation of the fluid takes place in an atomisation zone 49 of the spray head 14, which is, for example, formed to be funnel-shaped, bell-shaped or similar.

An air pressure regulator 51 is preferably provided for controlling the air flow to be dispensed via the nozzle 38, said regulator 51 being adjustable via an operating element or control element 52, in particular a control wheel. Advantageously, such an air regulator 51 is also provided with a control element 52 in the pressure line 28.

The receiving space 29 is part of a housing wall or is adjacent to a housing wall, wherein the housing 12 advantageously comprises a viewing window 54 in the region of the storage container 41, in order to be able to identify the filling level in the storage container 41.

The storage container 41 according to FIG. 1 is formed as a cartridge which comprises a cartridge base 56 having a connection opening 57, which can be connected to the connecting piece 31 after the insertion of the storage container 41 into the receiving space 29, in particular can be latched or clipped. There is thus an air-tight connection between the connecting piece 31 and the storage container 41. Furthermore, a displaceable base 59 is preferably provided in the storage container 41, which has a sealing lip 61 on its outer side for sealing an inner space 62. The base 59 additionally has a bulge 63 which is orientated towards the inner space 62.

The operating button 21 is actuated for dispensing the sprayable fluid. The drive motor 18 is powered by the accumulator 19. The drive motor 18 drives the air pump 22, whereby an air flow is generated. The mass flow of the air flow is led into the storage container 41 via a pressure line 28, whereby an overpressure between the cartridge base 56 and the displaceable base 49 is built up.

The displaceable base 59 is displaced in the direction of the closure 42. The fluid is thus led to the nozzle 46 via the fluid line 44 and is dispensed. Simultaneously, the second mass flow of the air flow is led to the nozzle 38 via the hose line 36 and dispensed. An atomisation of the fluid thus takes place in the atomisation zone 49, whereby spraying of the sprayable fluid takes place in the dispensing direction according to arrow 65. In the case of a vacuum arising in which the fluid is pulled out of the nozzle 46 via the fluid line 44 by means of the air flow, the fluid space is balanced again in terms of pressure.

As soon as the operating button 21 is released or actuated once more, the drive motor 18 switches off. The pressure between the cartridge base 56 and the displaceable base 59 is thus reduced. The displaceable base 59 returns to its initial position, whereby a slight underpressure is generated, by means of which the fluid in the fluid line 44 is drawn back into the inner space 62 of the storage container 41 again.

The fluid line 44 is formed to be several times shorter in proportion to the hose line 36. The smaller amount collecting in the fluid line 44 is thus led back into the storage container 41 again after the drive motor 18 is switched off in order to avoid the fluid line drying out.

The spray head 14 is opened for exchanging the storage container 41, as this is depicted according to the arrow 67 in FIG. 2. Directly after the opening of the spray head 14, i.e. during raising of the housing 12, a protective device 71 is activated which surrounds the needle 45 in order to avoid danger of injury. The protective device 71 can be transferred into the protective position by means of an energy storage element 72. After replacement of the storage container 41, the spray head 14 is delivered to the housing 12 and the protective device 71 is returned to an initial position again, by contact with, for example, the closure 42 or a further abutment element on the housing 12.

In FIG. 3, the dispensing device 11 is formed for receiving a storage container 41 formed as a tubular bag. This arrangement differs from that of FIG. 1 in that the receiving space 29 is sealed in an air-tight manner after the insertion of the tubular bag, or the tubular bag is attached to an upper edge of the receiving space 29 in such a manner that a closed space between the base 32 of the receiving space 29 and the inserted tubular bag is created. A pressure can thus be built up again in the receiving space 29 in order to discharge the fluid from the tubular bag.

In FIG. 4, an alternative embodiment to FIGS. 1 and 2 is depicted.

The embodiment depicted in FIG. 4 is described below with regard to the deviations. With respect to the further features and alternatives, reference is made to the above-mentioned description of the Figures.

In the embodiment according to FIG. 4, the spray head 14 is not pivotable, but rather is transferrable from a closed position, as is shown in FIG. 4, into an open position by means of a guide 75. This guide 75 can be formed as a sliding guide which independently positions the spray head 14 relative to the housing 12 by a latching, both in the closed position and in the open position. The fluid line 44 and the needle 45 projecting into the closure 42 are led out vertically from the housing 12 by the displacement movement of the spray head 14 during opening or raising of the spray head 14. Subsequently, the receiving space 29 becomes accessible from an end face which also points in the exit direction 65 of the fluid. After the spray head 14 is fully elevated and the needle 45 is fully led out from the closure 42, the storage container 41 can be gripped from the front and led out. Subsequently, a new storage container 41 is firstly inserted into the receiving space 29 according to the direction of the arrow 76, wherein this storage container 29 is then transferred downwards at a right angle onto the connecting piece 31 by a guide surface 77 on the receiving space 29 in an insertion movement. After a further pressure movement onto the storage container 41 according to arrow 76, this storage container latches independently with the cartridge base 56 on the connecting piece 31. Preferably, a self-latching clip connection or similar is provided. Finally, the spray head 14 is, in turn, moved onto the housing 12 and the receiving space 29 is closed.

In this closed arrangement of the dispensing device 11, the end face which, for example, forms the window 54 in FIG. 1, is free, i.e. the viewing window 54 is not present. Instead, the storage container 41 has a viewing window in order to identify the filling level. This end face of the storage container 41 is flush with the housing 12.

In this embodiment, the receiving space 29 is formed to deviate in such a manner that this receiving space 29 has an open portion which is open forwards against the direction of insertion, said portion transitioning into a half-cylindrical wall portion 78 which is closed by the deflection surface 76 on an upper side. The base 32 of the receiving space 32 is provided opposite. The storage container 41 can thus be inserted simply from the front and connected to the connecting piece 31 in a latched manner.

The spray head 14 according to FIG. 4 is furthermore formed alternatively to that of FIG. 1. For example, the hose line 36 is not directly connected to the nozzle 38. Rather, a pressure space 39 is formed in the spray head 14, said pressure space 39 having a first opening 79 to which the hose line 36 is connected. This leads the air flow into the pressure space 39. Furthermore, the pressure space 39 is in communication with the nozzle 38, whereby the accumulated or pent-up air in the pressure space 39 is dispensed in the flow direction 65. Pressure fluctuations in the hose line with the air flow generated can be balanced by this pressure space 39.

Preferably, the nozzle 38 is formed as a small tube which projects at least partially into the pressure space 39. The fluid line 44 is also preferably formed as a small tube. This can be provided in all embodiments.

Also in this embodiment according to FIG. 4, it can be provided that the hose line 36 is directly in communication with the nozzle 38.

The hose line 36 is either flexible or provided with an excess length, such that the spray head 14 can also carry out a retraction movement or extension movement along the guide 75 relative to the housing 12.

The nozzle 44 and the nozzle 38 are advantageously arranged at an angle relative to each other of less than 90°. These are also separated from each other.

In all embodiments, it can advantageously be provided that a filter element is provided in the housing interior assigned directly to the air inlet openings 23, such that no particles of dirt can pass into the housing interior in order to enable a longer lifespan of the air pump 22.

In FIG. 5, a perspective view of an alternative embodiment of the dispensing device 11 to FIG. 1 is depicted. FIG. 6 shows the alternative dispensing device 11 according to FIG. 5 having a housing 12 which is partially not depicted. FIG. 7 shows a schematic sectional view of the dispensing device 11 according to FIG. 5 for further depiction of the arrangement of the individual components relative to one another.

The dispensing device 11 comprises a housing 12 which is exemplarily formed in two parts, such that a first housing half is removable from the second housing half. An exchange of at least the storage container 41 can thus take place in a simplified manner. It can alternatively be provided that a housing portion is removable from the housing 12, said housing portion 12 only enabling access for inserting a storage container 11 and/or a closure 42 and/or a spray head 14, such that all further components remain closed by the housing 12.

A motor 18 is provided in the housing 12 which is in contact with a control 17 on a lower end. Furthermore, the motor 18 is connected to accumulators 19, as is the control 17. The drive motor 18 can be activated by an operating button 21 on the housing 12, whereby an air pump 22 which generates an air flow is driven. This air flow is supplied to the spray head 14 via the hose line 36. In particular, the nozzle 38 is thus supplied with the air flow. A connection 81 is provided between the hose line 36 and the spray head 14. This connection 81 is preferably formed as a plug connection. By plugging or placing a connector on the spray head 14 in or on the hose line 36, a media-tight connection can be created. This connection can be releasable, such that the spray head 14 can be formed to be exchangeable.

The spray head 14 comprises the first nozzle 38 which has an exit direction for the air flow according to arrow 65. The second nozzle 46 is orientated at an angle preferably of less than 90°, in particular 89° to 80°. Stored fluid in the storage container 41 is dispensed via the second nozzle 46. An atomisation zone 49 is formed outside of the spray head 14 by this arrangement and orientation of the nozzles 38, 46 relative to each other. The fluid is conveyed out of the storage container 41 by the air flow dispensed from the nozzle 38, because an underpressure is generated on the nozzle 46 by the air flow of the nozzle 38. This embodiment of the spray head 14 has the advantage that, when the dispensing device 11 is switched off, the fluid is retracted from the fluid line 44, in particular the nozzle 46, and returns into the storage container 41. Drying out of the nozzle 64 can thus be prevented.

According to the embodiment depicted in FIG. 7, the storage container 41 and the closure 42 are formed in one piece. The spray head 14 is releasably attached thereon. Here, it can be provided by a flange connection, latch connection, clip connection, plug connection or screw connection. Alternatively, it can be provided that the spray head 14 and the closure 42 are formed in one piece, such that a simple mounting of the spray head 14 on the storage container 41 is possible. Alternatively, the spray head 14 and the storage container 41 can also be formed in one piece, such that these form a retail unit which can be completely inserted into the housing 12. The storage container 41 can comprise a supply air opening, such that there is independently a pressure equalisation in the storage container 41 during the dispensing the medium.

According to an alternative embodiment, the spray head 14 can have at least one nozzle 46 which, seen in cross-section, has a frusto-conical body surrounding the nozzle opening. The nozzle opening can be provided to be raised with respect to the frusto-conical surface. This nozzle 46 is preferably in the air flow exiting the first nozzle 38 with the mouth or the exit opening or is positioned adjacently to the air flow. A better flow around the nozzle 46 can thus take place by means of the air flow in the discharge direction 65 from the nozzle 38. Simultaneously, clogging of the nozzle 46 can thus be prevented over at least a longer period of time. The nozzle exit of the nozzle 38 can be in a surface bordering the atomisation zone 49 on the spray head 14 or can also have a frusto-conical contour 42.

It is preferably provided, and not depicted in more detail, that a protective cover can be placed on the spray head 14. Preferably, this protective cover can have one or more closure elements, wherein at least one closure element for the nozzle 46 dispensing fluid is provided. Thus, additionally, drying out can be prevented. Such a protective cover additionally serves to protect from damage.

Also in this alternative embodiment, an opening 79 can be provided on the housing 12, in order to read the filling level of the storage container 41 in a simple manner.

The spray head 14 and the atomisation zone 49 are depicted schematically enlarged in FIG. 8, in which the positioning and assignment of the nozzle 38 and the nozzle 49 is depicted. The nozzle opening of the nozzle 46 projects at least slightly into the fluid jet which is discharged from the nozzle 38, in order to atomise the medium supplied by this nozzle 46. The nozzle opening of the nozzle 46 protrudes relative to an inclined surface bordering the atomisation zone 49. This inclined surface is provided to be descending starting from the nozzle 38, such that the surface opens relative to the atomisation zone 49. The nozzle 38 can protrude relative to an end face of the spray head 14, as this is depicted in FIG. 8, or can, however, also be positioned flush with the end face of this inclined surface.

The invention claimed is:

1. A dispensing device for spraying a sprayable fluid which is formed as a hand-held appliance, having:

a housing in which an air pump and an electric drive motor driving the air pump is provided, which generates an air flow, a spray head which is in communication with the housing for dispensing the fluid, a receiving space arranged in the housing for a storage container in which the fluid to be dispensed is stored, a fluid line leading from the storage container to the spray head, and a hose line leading from the air pump to the spray head, wherein the spray head has a first nozzle in communication with the fluid line and a tip of the first nozzle protrudes outside an outer wall of the spray head, and wherein the spray head has , a second nozzle that is separate from the first nozzle, the second nozzle being supplied with the air flow from the hose line and the second nozzle is formed by a bore hole in the spray head in which an opening of the bore hole is flush with the outer wall of the spray head, wherein the first nozzle dispenses fluid from the storage container to outside of the spray head in a first direction through the tip, and the second nozzle dispenses air from the air pump to outside of the spray head in a second direction through the opening of the bore hole, wherein the first and second nozzles are arranged such that the first direction and the second direction are angled relative to each other, and such that the fluid from the first nozzle intermixes with the air from the second nozzle outside the spray head to form an atomization zone outside the spray head, wherein the spray head is mounted on the storage container to form an exchangeable unit that is removable from the receiving space of the housing, and wherein a releasable connection provides an air-tight connection between the hose line and the spray head, the releasable connection being configured such that the exchangeable unit, including the spray head and the storage container together, is releasable from the hose line and removable from the housing for enabling another exchangeable unit to be received in the receiving space of the housing and connected to the hose line in an air-tight manner.

2. The dispensing device according to claim 1, wherein the first direction and the second direction are arranged perpendicularly or at an angle $\alpha$ of less than 90° relative to each other.

3. The dispensing device according to claim 1, wherein the spray head is arranged on a releasable closure of the storage container, or the spray head is formed in one piece with the closure or in one piece with the storage container.

4. The dispensing device according to claim 1, wherein the spray head is configured to dispense the fluid via the first nozzle from the storage container at a flow rate in a range from from 1 to 10 l/min.

5. The dispensing device according to claim 1, wherein the fluid provided in the storage container is made of natural substances on a water basis.

6. The dispensing device according to claim 1, wherein an accumulator for supplying the drive motor and a charging connection are provided in the housing.

7. The dispensing device according to claim 1, wherein the releasable connection is a releasable plug connection.

8. The dispensing device according to claim 1, wherein the releasable connection is a releasable clamp connection.

9. The dispensing device according to claim 1, wherein the releasable connection is a releasable screw connection.

10. The dispensing device according to claim 1, wherein the spray head is formed as a single piece including the first and second nozzles.

11. The dispensing device according to claim 1, wherein the outer wall of the spray head includes a first outer face that faces in a vertical direction, and the tip of the first nozzle protrudes upwardly from the first outer face; and the outer wall of the spray head has a second outer face that faces in a horizontal direction, and the opening of the bore hole of the second nozzle is flush with the second outer face; wherein the first and second outer faces are unitary with each other.

12. The dispensing device according to claim 11, wherein the first outer face and the second outer face are arranged perpendicularly relative to each other.

13. The dispensing device according to claim 1, wherein the exchangeable unit is releasable from the hose line and removable from the housing while the air pump and electric drive motor are maintained in the housing.

14. A dispensing device for spraying a sprayable fluid which is formed as a hand-held appliance, having:

a housing in which an air pump and an electric drive motor driving the air pump is provided, which generates an air flow a spray head which is in communication with the housing for dispensing the fluid, a receiving space arranged in the housing for a storage container in which the fluid to be dispensed is stored, a fluid line leading from the storage container to the spray head and a hose line leading from the air pump to the spray head, wherein the spray head has a first nozzle in communication with the fluid line and a tip of the first nozzle protrudes outside an outer wall of the spray head in which the tip is formed with a frusto-conical body surrounding an opening of the first nozzle, and wherein the spray head has a second nozzle that is separate from the first nozzle, the second nozzle being supplied with the air flow from the hose line and the second nozzle is formed by a bore hole in the spray head in which an opening of the bore hole is flush with the outer wall of the spray head, wherein the first nozzle dispenses fluid from the storage container to outside of the spray head in a first direction through the tip, and the second nozzle dispenses air from the air pump to outside of the spray head in a second direction through the opening of the bore hole, wherein the first and second nozzles are arranged such that the first direction and the second direction are angled relative to each other, and such that the fluid from the first nozzle intermixes with the air from the second nozzle outside the spray head to form an atomization zone is formed outside the spray head, wherein the spray head is mounted on the storage container to form an exchangeable unit, and wherein a releasable connection provides an air-tight connection between the hose line and the spray head, the releasable connection being configured such that the exchangeable unit, including the spray head and the storage container together, is releasable from the hose line and removable from the housing as a unit for enabling another exchangeable unit to be received in the receiving space of the housing and connected to the hose line in an air-tight manner.

15. The dispensing device according to claim 14, wherein the releasable connection is a releasable plug connection.

16. The dispensing device according to claim 14, wherein the releasable connection is a releasable clamp connection.

17. The dispensing device according to claim 14, wherein the releasable connection is a releasable screw connection.

18. The dispensing device according to claim 14, wherein the spray head is formed as a single piece including the first and second nozzles.

19. The dispensing device according to claim 14, wherein the outer wall of the spray head includes a first outer face that faces in a vertical direction, and the tip of the first nozzle protrudes upwardly from the first outer face; and the outer wall of the spray head has a second outer face that faces in a horizontal direction, and the opening of the bore hole of the second nozzle is flush with the second outer face; wherein the first and second outer faces are unitary with each other.

20. The dispensing device according to claim 14, wherein an upper portion of the housing forms a cover that at least partially overlies the spray head, and the exchangeable unit is releasable from the hose line and removable from the housing without removing the cover and while the air pump and electric drive motor are maintained in the housing.

* * * * *